US012053078B2

(12) United States Patent
Ritz

(10) Patent No.: US 12,053,078 B2
(45) **Date of Patent: *Aug. 6, 2024**

(54) FLEXIBLE EYEBROW TEMPLATE

(71) Applicant: Laura Ritz, Austin, TX (US)

(72) Inventor: Laura Ritz, Austin, TX (US)

( * ) Notice: Subject to any disclaimer, the term of this patent is extended or adjusted under 35 U.S.C. 154(b) by 431 days.

This patent is subject to a terminal disclaimer.

(21) Appl. No.: 17/338,319

(22) Filed: Jun. 3, 2021

(65) Prior Publication Data

US 2021/0282536 A1 Sep. 16, 2021

Related U.S. Application Data

(63) Continuation of application No. 16/364,503, filed on Mar. 26, 2019, now Pat. No. 11,044,982.

(60) Provisional application No. 62/649,165, filed on Mar. 28, 2018.

(51) Int. Cl.
*A45D 40/30* (2006.01)

(52) U.S. Cl.
CPC ..... *A45D 40/30* (2013.01)

(58) Field of Classification Search
CPC ..... A45D 40/30; A45D 44/00; A45D 44/002; A45D 44/12; A45D 2040/0006; A45D 27/42; A45D 24/36; A45D 26/00; A45D 2200/25
USPC ..... D28/7–10
See application file for complete search history.

(56) References Cited

U.S. PATENT DOCUMENTS

| | | | | |
|---|---|---|---|---|
| 3,300,864 | A * | 1/1967 | Lesslie | A61B 5/107 132/216 |
| 6,336,462 | B1 | 1/2002 | Santelli et al. | |
| 2003/0234028 | A1 | 12/2003 | Edell | |
| 2006/0249173 | A1* | 11/2006 | Lawson | A45D 40/30 132/319 |
| 2014/0158147 | A1 | 6/2014 | Butcher | |

FOREIGN PATENT DOCUMENTS

| | | | | |
|---|---|---|---|---|
| DE | 202013008900 U1 * | 2/2014 | | A45D 40/30 |
| WO | WO-2019094493 A1 * | 5/2019 | | |

* cited by examiner

*Primary Examiner* — Cris L. Rodriguez
*Assistant Examiner* — Karim Asqiriba
(74) *Attorney, Agent, or Firm* — Sean Lynch; Lynch LLP

(57) ABSTRACT

Eyebrow templates are disclosed in this application. Eyebrow templates of the inventive subject matter can have a top portion, or both a top portion and a bottom portion. In embodiments with only a top portion, a bottom edge includes contours to facilitate makeup application to a user's eyebrows. Templates can be made from stretchy or flexible materials that include an adhesive to stick them to a user's skin. Guide lines can be included to facilitate application of makeup to the bottom edges of a user's eyebrows, and brush stroke guide lines can also be included to help guide a user's brush strokes when applying makeup.

8 Claims, 2 Drawing Sheets

FLEXIBLE EYEBROW TEMPLATE

This application is a continuation of and claims priority to U.S. patent application Ser. No. 16/364,503, filed Mar. 26, 2019, which claims priority to and the benefit of U.S. provisional patent application, Ser. No. 62/649,165, filed Mar. 28, 2018. All extrinsic materials identified in this application are incorporated by reference in their entirety.

FIELD OF THE INVENTION

The field of the invention is eyebrow templates to facilitate makeup application.

BACKGROUND

The background description includes information that may be useful in understanding the present invention. It is not an admission that any of the information provided in this application is prior art or relevant to the presently claimed invention, or that any publication specifically or implicitly referenced is prior art.

Application of makeup and other cosmetics is a massive industry, constantly looking for new innovations and new ways to improve the lives of its consumers. One area that is the subject of constant innovation is eyebrow makeup. Eyebrows are difficult to get right, and many people go so far as to have eyebrows tattooed on to avoid the nuisance of needing to tend to their eyebrows every day. One problem with tattoos is, of course, their permanence.

Others have attempted to invent unique new templates, but the templates that have been contemplated up to this point all suffer from fixable drawbacks. For example, U.S. Patent Publication No. 2003/0234028 teaches a very standard eyebrow template, which can easily be improved upon through the use of careful selection of materials.

In another example, U.S. Pat. No. 6,336,462 features an eyebrow shaping and waxing template. It teaches the broader idea of a template for the eyebrows to facilitate the application of makeup, but the '462 patent fails to consider several possible improvements. U.S. Patent Publication No. 2006/0249173 describes another template for applying cosmetics as well as tattoos, where the template can be made from a silicone or otherwise stretchable material.

In one more example, U.S. Patent Publication No. 2014/0158147 describes a template to help a person apply eye makeup. It teaches the use of a two-part template, but it fails to teach several improvements that could be made to the invention, such as including guide lines to help a customer create the proper bottom lines and the use of a single template to span the entire forehead.

On store shelves, eyebrow templates with the best, most modern brow shapes do not adhere to the skin and are typically made of a hard, plastic material. Users, therefore, are often forced to use a non-dominant hand to hold a template against the brow, and simultaneously use the dominant hand to fill in the template with eyebrow makeup of their choice. Using both hands simultaneously in this way is cumbersome and difficult, especially when in a hurry to leave for work! Moreover, because users are stuck holding templates with their non-dominant hands, old templates aren't flush with the skin, and as a result, makeup is often applied in a sloppy way. This process is cumbersome for any person who spends time on eyebrow makeup, and the results are frequently bad.

Some templates do have an adhesive backing, both those prior solutions are presented as a single piece with a fulleyebrow cutout. These solutions fail because the bottom portion of the eyebrow cutout always bubbles or wrinkles when it is pressed against eyelid skin or the bottom of a user's orbital cavity. When this bubbling or wrinkling exists, makeup can get beneath the bubbled or wrinkled area, ruining any chance of properly applying eyebrow makeup—it causes eyebrows to look messy. Having an eyebrow cutout using these kinds of materials is also difficult because a user cannot fully see what they are doing until after the makeup is completely applied and the stencil is taken off.

These and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

It has yet to be appreciated that eyebrow makeup templates can be improved upon to create more useful cosmetics products. Thus, there is still a need in the art for improved eyebrow templates.

SUMMARY OF THE INVENTION

The present invention provides apparatuses, systems, and methods related to eyebrow templates. In one aspect of the inventive subject matter, an eyebrow template is contemplated, comprising: a flexible material comprising a first contour on a bottom edge of the flexible material, the first contour corresponding to a first eyebrow shape; the flexible material further comprising a second contour on the bottom edge, the second contour corresponding to a second eyebrow shape; the flexible material further comprising a first guide line positioned above the first cutout, and a second guide line positioned above the second cutout; wherein the first and second guide lines are angled to facilitate application of makeup to bottom edges of a user's eyebrows; and the flexible material further comprising a non-toxic adhesive on a skin-facing side.

In some embodiments, the flexible material further comprises third and fourth guide lines angled to further facilitate application of makeup to the bottom edges of the user's eyebrows. In some embodiments, the flexible material comprises silicone. The flexible material can be stretchable to improve the flexible material's ability to adhere to the user's face without wrinkling. The flexible material can additionally include a vertical center line, and the vertical center line can include perforations to facilitate separation of a right side of the flexible material from a left side of the flexible material. In some embodiments, the flexible material is at least partially transparent.

The first guide line and the second guide line can be recessed relative to the rest of the flexible material to, for example, make it easier for people with vision impairments to apply makeup based on feel alone. The flexible material can additionally include brush stroke guide lines, and it is contemplated that the non-toxic adhesive can be reusable.

One should appreciate that the disclosed subject matter provides many advantageous technical effects including the use of a flexible eyebrow template that includes only a top portion with guide lines to help a user apply makeup to the bottom edges of their eyebrows, among many other advantages.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
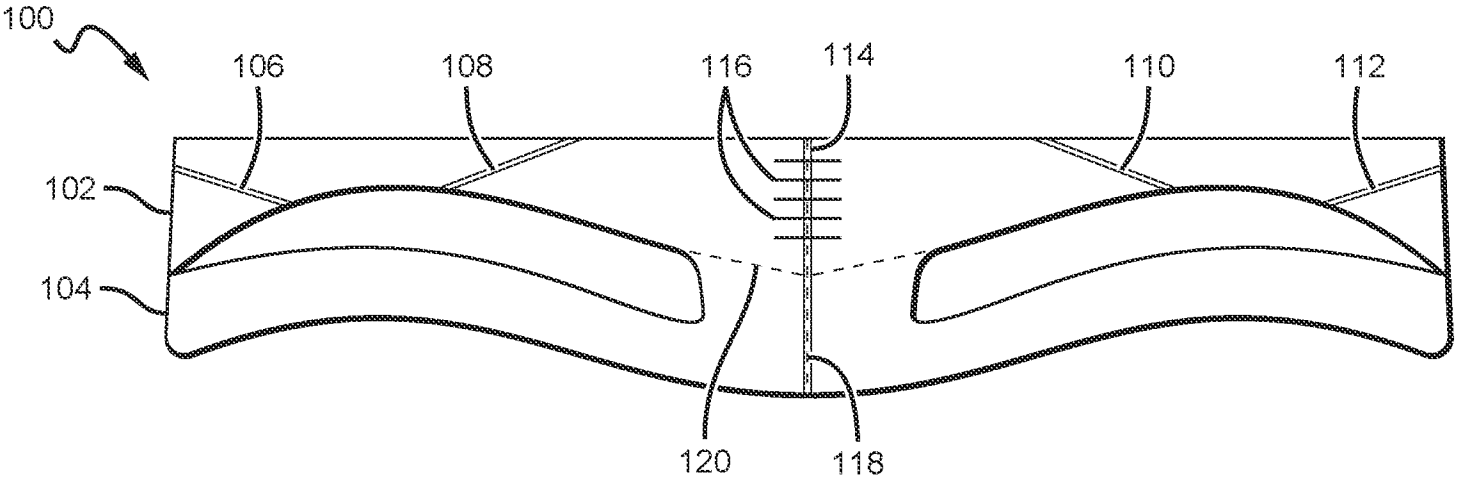
FIG. 1 shows an eyebrow template having a top portion and a bottom portion.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

The inventive subject matter is directed to eyebrow templates that incorporate features to improve ease of use and flexibility in eyebrow shaping. Embodiments of the inventive subject matter include a template that can span the width of a user's face. In some embodiments, the template includes both a top portion and a bottom portion, where the top portion of a template is positioned across the user's forehead above the eyebrows and where the bottom portion (when it is included) goes below the eyebrows. In other embodiments, only a top portion is included. Forehead-spanning templates—as opposed to separate templates for each eye—help users ensure their eyebrows are being applied evenly and symmetrically. This also cuts down on valuable makeup application time.

Figure 2:
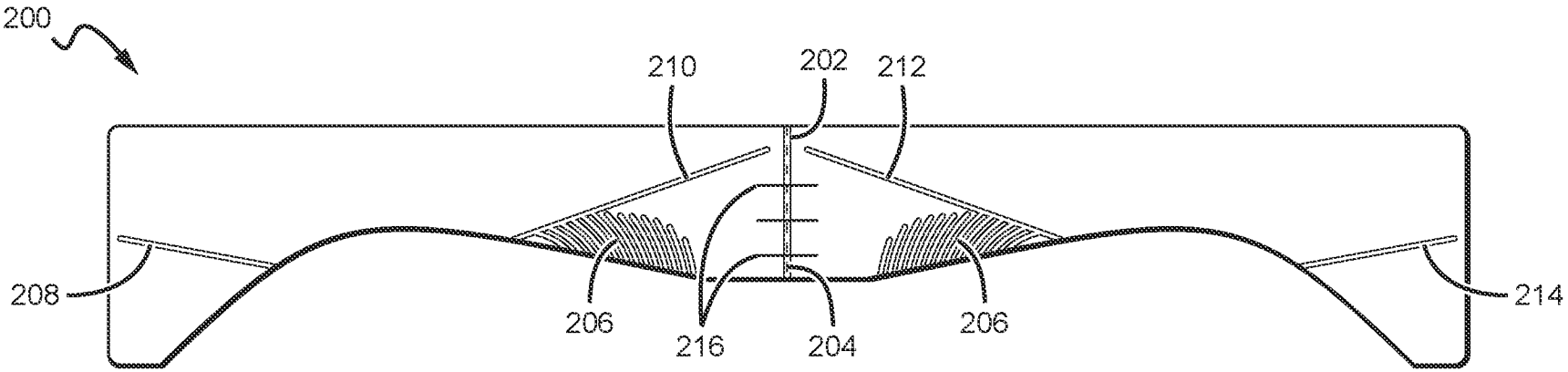
FIG. 2 shows an eyebrow template having just a top portion.

Eyebrow templates of the inventive subject matter can include a top portion and a bottom portion (e.g., as shown in FIG. 1), but in some embodiments only the top portion is needed (e.g., as shown in FIG. 2). Guide lines can be included on any embodiment to help a user create clean makeup lines, to guide brush strokes, and to help with template placement on a user's face. These guide lines come in a variety of different forms described throughout this application.

In some embodiments, a vertical guide line is included in the center of the top portion. Such a guide line can be seen in FIGS. 1-3. Taking FIG. 1 as an example, the vertical guide line 114 is a center line in that can be aligned in relation to the center of the nose to help users place the template 100 on their face symmetrically. In some embodiments, a vertical guide line 114 can also help users to create two separate brow templates. For example, a user can either cut the template in two with scissors or tear a template into two pieces along a perforation 118 that follows the vertical guide line 114. In another example shown in FIG. 2, a vertical guide line 202 includes perforations 204 that facilitate tearing the template into two along the vertical guide line 202. Perforations along the vertical guide line can be included in any embodiment. Tearing or cutting a template in two can facilitate customization for a user's particular face shape or bone structure.

Figure 4:
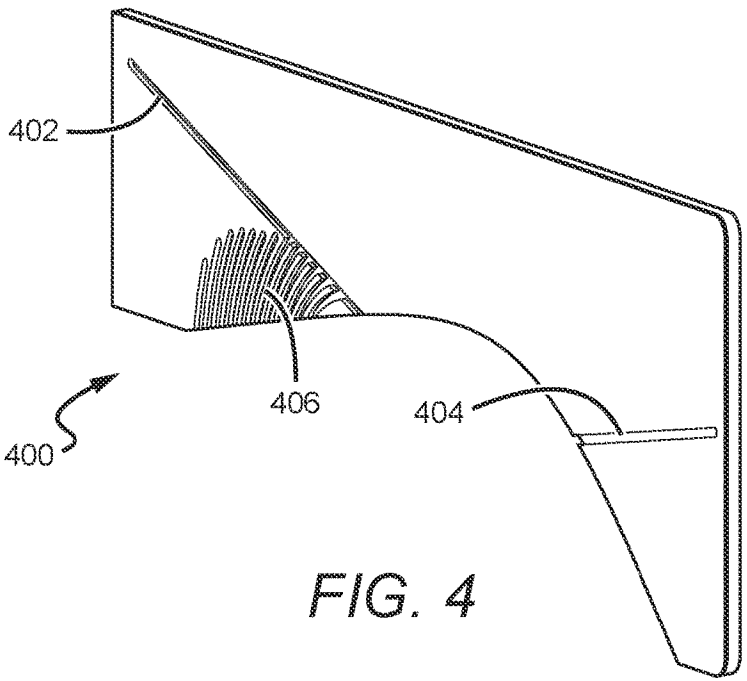
FIG. 4 shows an eyebrow template having recessed guide lines and brush stroke lines.

As shown in FIG. 2, embodiments can also include hair stroke guide lines 206, which guides users' brush strokes to help make their brows look more natural. One or more hair stroke guide lines 206 can be included. In some embodiments, hair stroke guide lines are included on a surface of an eyebrow template (e.g., printed or drawn on), while in other embodiments, they are formed as raised or recessed portions of the template (e.g., formed from the same material that forms a template). Hair stroke guide lines 206 can also include some coloration to make them more easily visible along with incorporating a tactile aspect. This can help people with vision impairments do their eyebrows confidently. FIG. 4 shows an embodiment having recessed guide lines. Hair stroke guide lines 206 mimic a user's natural hair growth pattern. The term "hair stroke" has been made popular by permanent eyebrow tattooing (e.g., microblading), where each tattooed mark is called a "hair stroke." By making it easier for users to create hair strokes with the help of the hair stroke guide lines, templates of the inventive subject matter can help achieve a look similar to a look achieved when a user has undergone microblading. Using a template instead of having microblading procedure saves users hundreds of dollars yearly and thousands over a lifetime.

Figure 3:
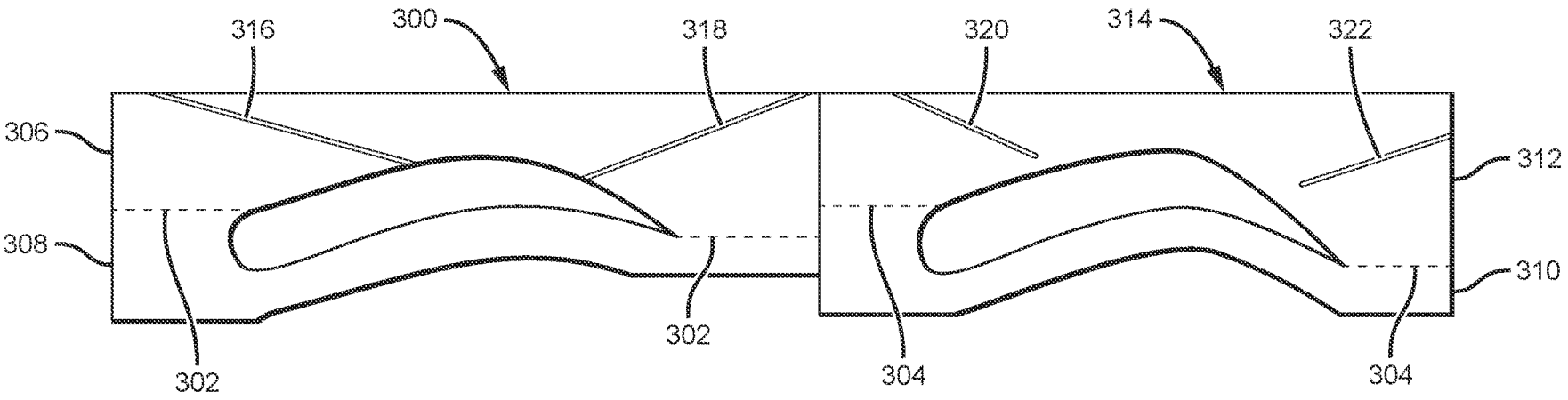
FIG. 3 shows an eyebrow template having perforations separating the top portion and the bottom portion.

As mentioned above, perforations can be included with any embodiment of the inventive subject matter to make it possible to break or tear a template into different pieces along one or more desired lines. Perforations 204 shown in FIG. 2, for example, allow a template to be separated in half down the middle along a vertical guide line 202. In another example, as shown in FIG. 3, a top portion of an eyebrow template can be separated from a bottom portion along perforations 302 & 304 that make it easier for a user to tear the two pieces apart. Perforations 302 facilitate separation of a top portion 306 from a bottom portion 308 of the template on the left 300, and perforations 304 facilitate separation of a top portion 312 from a bottom portion 310 of the template on the right 314. Unlike the embodiment contemplated in FIG. 2 where only a top portion is included, the embodiments shown in FIG. 3 can be formed as a single piece having a top portion and a bottom portion that can be optionally separated into different components as needed by a user. Thus, perforations can be included in various embodiments to facilitate separation of templates in parts vertically or in parts horizontally.

It is contemplated that templates of the inventive subject matter can be made from a variety of materials. In some embodiments, the material used is both stretchable and flexible, so that the template can conform to a user's face while minimizing the amount that the template can wrinkle or bubble away from the user's face when the user's skin is moved or pressed against while applying makeup. It is not desirable for an eyebrow template to separate away from a user's skin after it has been applied, because that can create an edge that catches eyebrow pencils and other makeup products, interfering with effective makeup application. Thus, materials used to create eyebrow stencils of the inventive subject matter are selected to minimize separation caused by movements in a user's face or skin. In some embodiments, templates of the inventive subject matter can also be made from soft materials, e.g., silicone or similar, which can minimize the likelihood of having an edge that can catch on a makeup product or applicator.

Templates of the inventive subject matter can be made from a variety of materials including silicone (e.g., silicone gel), thin cloth, sticker/paper material, flexible plastic, or any other material that is flexible, stretchable, or both. It is contemplated that the template, regardless of the material it is made from, can be adhered to skin using, for example, an adhesive (e.g., a non-toxic adhesive or hypoallergenic adhesive). An adhesive would be on a side of a template that is intended to be pressed against a user's skin so that the user can then apply makeup using the template as a guide. Template material is preferably thin enough to facilitate makeup application. In some embodiments, the template material can be thinner around the brow to reduce the edge created by the material. Template material can also be thicker around the perimeter of template. It is contemplated that templates of the inventive subject matter can be reusable up to 10-15 times—or more—as long as the adhesive still provides sufficient adhesion to hold the template to a user's face.

At a minimum, materials used to create templates of the inventive subject matter must be flexible. Transparent or translucent materials are contemplated (plastics, silicones, etc.) to help a user see what is beneath a template, thereby improving the user's ability to do their makeup effectively. In other embodiments, the material can be opaque. An adhesive can be included on the side of the template that rests against a user's forehead or face. Reusable and washable adhesives are contemplated, as mentioned above, which allow templates of the inventive subject matter to be used several times before the adhesive loses its ability to adequately hold a template to a user's face. One example of a reusable adhesive is a silicone gel adhesive. This adhesive is reusable, washable, and it can be made to be hypoallergenic. All of these qualities can be desirable in embodiments of the inventive subject matter, which are intended to rest directly against a user's skin.

FIG. 1 shows an eyebrow template 100 of the inventive subject matter having both a top portion 102 and a bottom portion 104. Although other embodiments are contemplated that do not include a bottom portion, the bottom portion 104 can nevertheless be included as it is in FIG. 1. Top portion 102 and bottom portion 104 can be separated such that the top portion 102 can be used without the bottom portion 104 (and vice versa). To facilitate use of the top portion 102 without the bottom portion 104, the template 100 includes a variety of markings. Guide lines 106, 108, 110, & 112 on the top portion 102 are intended to help a user apply makeup to their eyebrows even if they aren't using the bottom portion 104 of the template. These guide lines are angled such that they help a user to visualize where the bottoms of their eyebrows should be, which can help with makeup application even when only the top portion 102 is being used.

The embodiment in FIG. 1 shows two guide lines 106, 108, 110, & 112 on the top portion 102 for each eyebrow. These guide lines 106, 108, 110, & 112 are included on the top portion 102 of the template 100 to help a user to draw on the lower portions of their eyebrows even when they are using only the top portion 102 of the template 100. For example, guide lines 108 & 110 that run from the center of the face and downward away from the bridge of the nose to the farthest point of the eyebrow help a person draw on the bottom lines of their brows under the outside portions of their brows (i.e., the bottom portion of the brow that is farther from the nose). Guide lines 106 & 112 that begin on the portion of the template that is farthest from the bridge of the nose help a user draw the bottom lines of their brows under the inside portions of their brows (i.e., the bottom portion of the brow that is closer to the nose). Additional guide lines can be included, such as the guide lines closer to the bridge of the nose (as shown in, e.g., FIG. 2 as lines 206) meant to help guide a user's brush strokes. These additional hair stroke guide lines 206 can be incorporated in any embodiment.

The top portion 102 and the bottom portion 104 of the template 100 can be separate pieces, split horizontally (e.g., along perforations 120), so that they can be spaced apart by different amounts depending on a user's desired eyebrow thickness. In some embodiments, the top portion 102 can be used in the absence of the bottom portion 104. The center portion of the template 100 near the bridge of the nose includes a vertical guide line 114 to help a user center the template 100 on their face according to the location of the bridge of their nose. That vertical guide line 114 can also include markings 116 to, e.g., further facilitate placing the template on a user's face in a desired position or even to help guide brush strokes.

FIG. 2 shows a template of the inventive subject matter that includes only the top portion of the template 200. It includes several guide lines 208, 210, 212, & 214 for each eyebrow, similar to the embodiment shown in FIG. 1. For example, the left side includes a guide line 210 that points downward away from the center of the face to help draw the outside bottom line of the eye brow, and it also includes a guide line 208 that points downward toward the center of the face to help draw the inside bottom line of the eyebrow. The same is true for the right side of the template 200 with guide lines 212 & 214, which are positioned symmetrically to guide lines 208 & 210. The template 200 shown in FIG. 2, like the one shown in FIG. 1, also includes a vertical guide line 202 located at the center of the template 200 that helps a user place the template 200 in the center of their face relative to the bridge of the nose. The small hash marks 216 on the vertical guide line 202 can be used to place the template 200 in a desired location on the face relative to a user's eyebrows, depending on a desired vertical positioning of the template 200.

As mentioned above, guide lines 208, 210, 212, & 214 can be included to help users to do their eyebrow makeup even when no bottom portion accompanies the top portion. Guide lines can be included on templates of the inventive subject matter to make it easier for users to see what they're doing from different distances (e.g., helping users that cannot stand immediately adjacent to a mirror, or helping users with vision impairments). In some embodiments, the guide lines are expressed in bright colors. In some embodiments, the guide lines can also be made from material that is extruded or sunken relative to the rest of the template to give the guide lines a tactile feel, which can, for example, help vision-impaired users. FIG. 4 shows an example of a portion of an eyebrow template 400 that has sunken guide lines 402 & 404, along with sunken brush stroke guides 406. Sunken guide lines can improve makeup application by provide a crevice for a brow pencil to move into during makeup application, thereby facilitating smoother makeup application when using templates having sunken guide lines.

FIG. 3 shows two example left eye portions 300 & 314 of templates of the inventive subject matter that include both a top portion 306 & 312 and a bottom portion 308 & 310. Although the right eye portion is not shown, it is contemplated that for each left eye portion shown in FIG. 3, there would ordinarily be an accompanying right side portion (as shown in FIGS. 1 & 2) since templates of the inventive subject matter are designed to span across the face (unless separated down the vertical guide line in the center of a template, as discussed above).

Templates 300 & 314 shown in FIG. 3 include guide lines 316, 318, 320, & 322 to help a user draw the bottom portion of their eyebrow, as described above with respect to other embodiments. Each of the two left eye portions 300 & 314 shown in FIG. 3 include two guide lines 316 & 318 and 320 & 322, one for the inside bottom line of the eyebrow and one for the outside bottom line of the eyebrow when the bottom portions 308 & 310 of the templates 300 & 314 aren't being used. The bottom portions 308 & 310 are shown in both templates 300 & 314 and can be positioned and repositioned relative to the top portions 306 & 312 based on the desired thickness of the eyebrow.

Thus, specific eyebrow templates have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. An eyebrow template, comprising:

a left contour on a bottom edge of a left portion of the eyebrow template, the left contour corresponding to an upper edge of a left eyebrow shape;

a right contour on a bottom edge of a right portion of the eyebrow template, the right contour corresponding to an upper edge of a right eyebrow shape;

a first guide line extending from the left contour, and a second guide line extending from the right contour;

wherein the first and second guide lines are angled to correspond, respectively, to a bottom edge of the left eyebrow shape and a bottom edge of the right eyebrow shape;

wherein the first guide line extends from a left portion of the left contour and the second guide line extends from a right portion of the right contour; and wherein the third guide line and the fourth guide line are angled relative to a the vertical center line, the first and second guide lines, and to each other.

2. The eyebrow template of claim 1, wherein the eyebrow template is made from a flexible material.

3. The eyebrow template of claim 2, wherein the flexible material comprises silicone.

4. The eyebrow template of claim 2, wherein the flexible material is also stretchable to improve an ability of the flexible material to adhere to a user's face without wrinkling.

5. The eyebrow template of claim 2, wherein the flexible material is at least partially transparent.

6. The eyebrow template of claim 1, further comprising third and fourth guide lines, wherein the third guide line extends from a right portion of the left contour and wherein the fourth guide line extends from a left portion of the right contour.

7. The eyebrow template of claim 1, wherein the first guide line and the second guide line are recessed relative to the rest of the flexible material.

8. The eyebrow template of claim 1, further comprising brush stroke guide lines.

* * * * *